United States Patent [19]

Niemiec

[11] Patent Number: 4,480,962

[45] Date of Patent: Nov. 6, 1984

[54] PUMP WITH INLET PASSAGES DOWNSTREAM AND THROUGH ITS FLOW CONTROL VALVE

[75] Inventor: Albin J. Niemiec, Sterling Heights, Mich.

[73] Assignee: Vickers, Incorporated, Troy, Mich.

[21] Appl. No.: 423,460

[22] Filed: Sep. 24, 1982

Related U.S. Application Data

[63] Continuation of Ser. No. 177,369, Aug. 11, 1980, abandoned.

[51] Int. Cl.[3] ..... F04B 49/08

[52] U.S. Cl. ..... 417/53; 417/302; 417/307; 417/300

[58] Field of Search ..... 417/300, 302, 53, 307

[56] References Cited

U.S. PATENT DOCUMENTS 3,207,077 9/1965 Zeigler et al. ..... 417/300

3,619,085 11/1971 Nuss ..... 417/300

*Primary Examiner*—Richard E. Gluck

*Attorney, Agent, or Firm*—Barnes, Kisselle, Raisch, Choate, Whittemore & Hulbert

[57] ABSTRACT

A hydraulic system comprising a fixed displacement pump driven by a prime mover operable at variable speeds and a flow control valve operable to return a portion of the hydralic fluid from the outlet of the pump to the inlet of the pump and draw fluid from a reservoir to replenish the fluid at the inlet when the pump is operated at higher speeds. An auxiliary passage extends from the reservoir and communicates with the inlet of the pump upstream from the system flow drawn from the reservoir by the opening of the flow control valve and normally isolated during low speed operation from the bypass flow by the flow control valve thereby providing auxiliary flow to the inlet at lower speeds.

3 Claims, 1 Drawing Figure

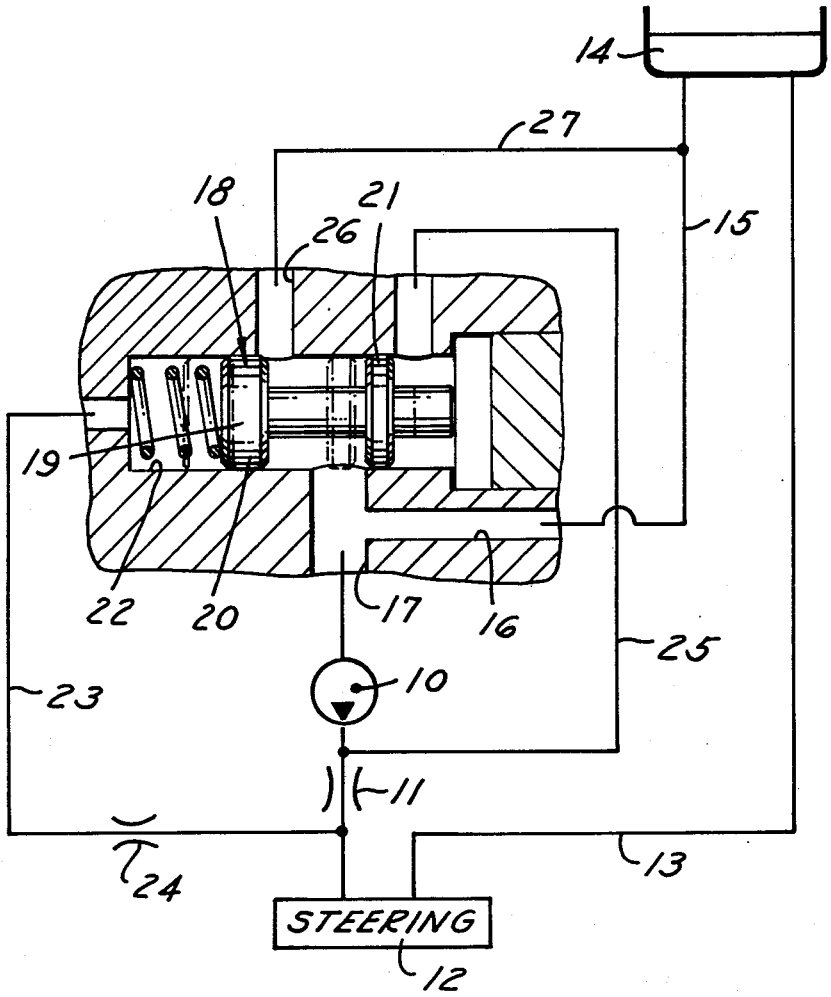
14
27
18
21
26
15
19
22
20
17
16
25
23
10
11
24
13
STEERING
12

PUMP WITH INLET PASSAGES DOWNSTREAM AND THROUGH ITS FLOW CONTROL VALVE

This is a continuation of application Ser. No. 177,369, filed Aug. 11, 1980, now abandoned.

This invention relates to hydraulic systems and particularly to hydraulic systems such as power steering systems which utilize a fixed displacement pump driven by a prime mover that operates at variable speeds.

BACKGROUND AND SUMMARY OF THE INVENTION

In hydraulic systems utilizing fixed displacement pumps driven by variable speed prime movers such as utilized in power steering systems for automotive vehicles, the system operates at a predetermined constant volume controlled by a flow control valve. The flow control valve also provided the fluid mechanics for replenishing the flow directed to the power steering booster by bypassing some of the fluid to the inlet of the pump when the pump is operated at higher speeds. However, in such a system, at the lower speeds, because of the restricted size of the passage for replenishing the flow by fluid returning from the power booster, it is common that there may be excessive inlet vacuum and cavitational damage especially at larger control flows and at cold temperatures when the fluid is very viscous. Typical systems are shown in U.S. Pat. Nos. 2,880,674 and 3,207,077.

Accordingly, the present invention is intended to provide a hydraulic system which will adequately provide hydraulic fluid at the lower speeds before the flow control valve begins to bypass fluid, which will permit an increased control discharge flow range, which will lower the sound level of operation of the pump, which will produce less wear associated with cavitation, which will permit more effective use of the shaft seals because of the lesser tendency to draw vacuum, and which will increase the pressure of the inlet due to the normal replenishing by the flow control valve.

In accordance with the invention, an auxiliary passage extends from the reservoir and communicates with the inlet of the pump upstream from the system flow drawn from the reservoir by opening of the flow control valve and normally isolated during low speed operation from the bypass flow by the flow control valve thereby providing auxiliary flow to the inlet.

DESCRIPTION OF THE DRAWINGS

The single drawing is a partly schematic view of a hydraulic system embodying the invention.

DESCRIPTION

In accordance with the invention as shown in FIG. 1, the hydraulic system comprises a fixed displacement pump 10 driven by a prime mover such as the engine of an automotive vehicle to supply fluid through an orifice 11 to a steering booster 12 such as a linear or rotary hydraulic motor. In a normal system, the return of fluid through a line 13 is to a reservoir 14. Fluid from the reservoir normally flows through a line 15 and a passage 16 in the pump housing to the inlet 17 of the pump. A flow control valve 18 comprising a spool 19 having spaced lands 20, 21 is provided in a bore 22 and is operable in accordance with well known practive to bypass the fluid when the volume exceeds a predetermined rate. A line 23 extends from the outlet of the pump and has an orifice 24 therein to the spring end of the spool. When the volume exceeds a predetermined rate, the land 21 moves to the broken line position causing a portion of the fluid to flow through line 25 between the land 21 and the edge of the bore into the inlet 17. The passage 16 aspirates further hydraulic fluid flow through the inlet thereby supplementing the flow of fluid to the pump at the higher speed. Such systems are old and shown in the aforementioned U.S. Pat. Nos. 2,880,674 and 3,207,077 which should be referred to for details of construction.

In accordance with the invention, an auxiliary passage 26 is provided to valve 18 and communicates as shown diagrammatically by a line 27 with the reservoir 14. Passage 26 functions to provide supplemental flow of hydraulic fluid to the inlet 17 at the lower speeds. It is noted that the passage 26 is located upstream with respect to valve 18 and the outlet of the passage 16 and is hydraulically isolated from the fluid applied to the flow control valve through line 25 when the flow control valve is in closed position.

Thus, a hydraulic system embodying the invention provides improved filling at the inlet at the lower speeds before the flow control valve 18 begins to bypass the discharge volume, lowers the sound level, reduces the wear and maintenance that might be caused by vacuum and cavitational damage. The additional passage 26 also functions to increase the pressure at the inlet 17 supplementing the supercharging normally provided by the flow control valve 18 through line 25.

It can thus be seen that the auxiliary passage functions to permit flow at all times to the inlet 17 of the pump 10.

What is claimed is:

1. A power transmission comprising a fixed displacement pump adapted to be driven by a prime mover operable at variable speeds in a hydraulic system, where it is desired to have a predetermined volumetric flow to a load, said pump including at least a pumping region having an inlet and an outlet, a first tank line including at least a first tank passage to the inlet of the pumping region and a flow control valve including a valve bore receiving a spool having a land operable to return a portion of the hydraulic fluid from the outlet of said pump through a return line to the inlet of said pumping region, the land moving to a position where the return flow through the return line extends between said land and the valve bore into the inlet and aspirates hydraulic fluid from the first tank passage, characterized in that a second tank line is provided upstream of the first tank passage having an auxiliary passage which extends only through the flow control valve and therethrough and is at all times in communication with the inlet.

2. The power transmission set forth in claim 1, characterized in that only the return line and the auxiliary passage intersect the valve bore in similar flowing directions and upstream of the first tank line so as to join to the first tank passage in the inlet, when the land is in its position permitting return flow.

3. A method for supplying fluid to a pumping region of a fixed displacement pump adapted to be driven by a prime mover operable at variable speeds and including at least a pumping region having an inlet and an outlet, wherein a predetermined volumetric flow to a load is controlled by a flow control valve which, at higher pumping speeds, returns a portion of the hydraulic fluid from the outlet of the pump to the inlet, whereby fluid from a reservoir is aspirated through a first tank line including at least a first tank passage to the inlet of the pumping region, characterized in that supplemental fluid is directed upstream from the first tank passage through an auxiliary path from the reservoir through the flow control valve to the inlet, both when return flow from the outlet of the pump to the inlet is prevented or allowed, respectively, by the flow control valve.

* * * * *